United States Patent [19]

Luftig

[11] 3,986,662

[45] Oct. 19, 1976

[54] COMBINATION MAILING APPARATUS

[76] Inventor: Milton Luftig, 3 Fox Meadow Court, Woodbury, N.Y. 11797

[22] Filed: Apr. 23, 1975

[21] Appl. No.: 570,861

[52] U.S. Cl. ..... 229/71; 229/73

[51] Int. Cl.[2] ..... B65D 27/04

[58] Field of Search ..... 229/70, 71, 73

[56] References Cited

UNITED STATES PATENTS

| | | | |
|---|---|---|---|
| 1,568,880 | 1/1926 | Conklin | 229/70 |
| 1,962,921 | 6/1934 | Tullar | 229/71 |
| 2,304,517 | 12/1942 | White | 229/71 |
| 3,288,351 | 11/1966 | Benz, Jr. | 229/71 |

FOREIGN PATENTS OR APPLICATIONS

| | | | |
|---|---|---|---|
| 1,140,254 | 1/1969 | United Kingdom | 229/71 |

*Primary Examiner*—William Price
*Assistant Examiner*—Stephen Marcus
*Attorney, Agent, or Firm*—Amster & Rothstein

[57] ABSTRACT

A mailing apparatus is provided for sending a numbered communication through the mail including an attention-getting border contiguous said number. The invention includes a letter having an address area and a number area with the number area being surrounded by a border. An envelope is provided including openings therein covered by glassine windows permitting viewing of the address and number therethrough from the exterior of the envelope once the letter has been appropriately folded and properly inserted within the interior of the envelope. In one embodiment, the opening within the envelope permitting viewing of the numbered area on the letter therethrough is also configured to permit viewing therethrough of the border about the numbered area. Alternately, or in addition, the area of the envelope which permits viewing of the numbered portion of an appropriately inserted letter therethrough includes a border thereabout.

10 Claims, 8 Drawing Figures

FIG. 1
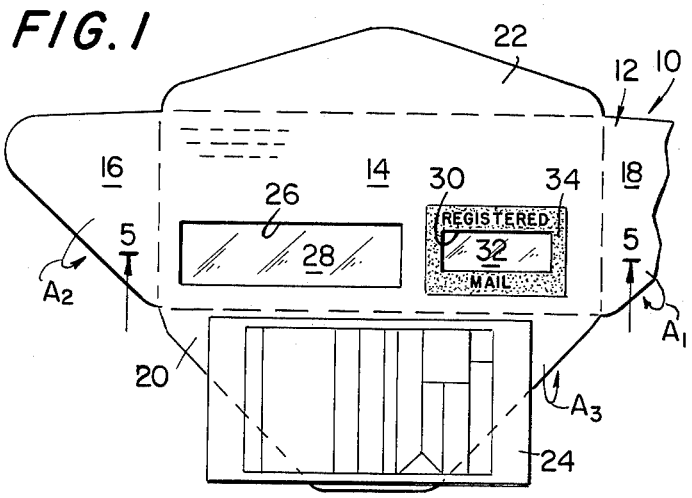
FIG. 2
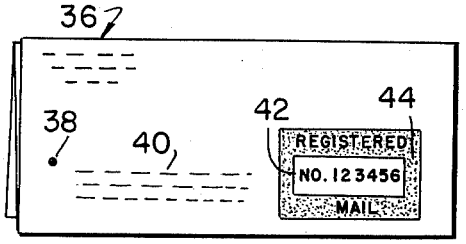
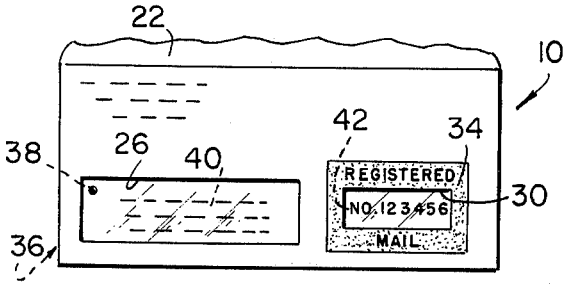
FIG. 3
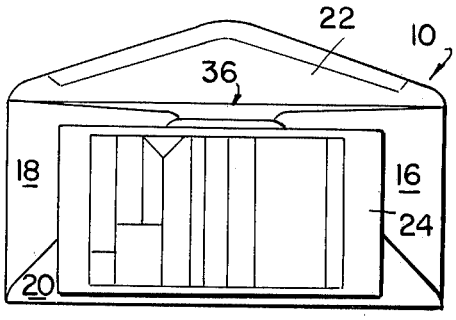
FIG. 4
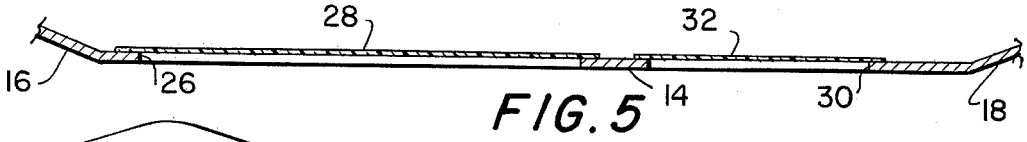
FIG. 5
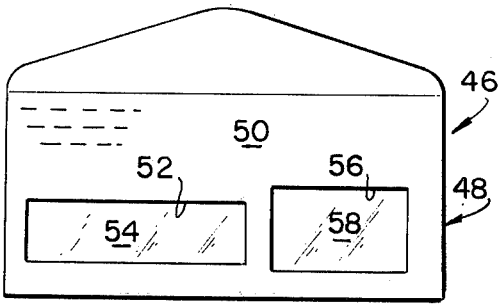
FIG. 6
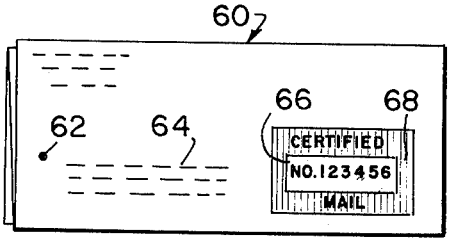
FIG. 7
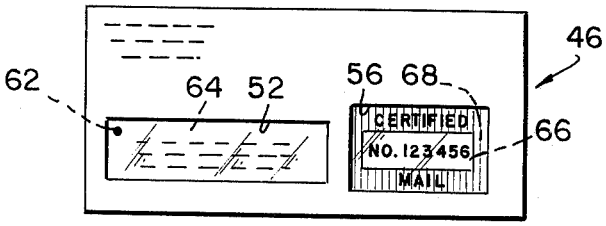
FIG. 8

COMBINATION MAILING APPARATUS

The present invention relates generally to mailing devices, and in particular to a combination mailing apparatus comprising a letter and envelope wherein the letter includes a number and an attention-getting border contiguous thereto.

Numerous devices have been available wherein envelopes and contents intended therefor have been presented to solve certain specific problems.

For example, envelopes have been designed to enclose a letter including thereon the addressor's name and address and the addressee's name and address. The envelope is designed so that the letter can be folded and inserted within the envelope which is configured to include appropriately placed windows therein so that the name and address of both the addressor and addressee on the letter are visible through the envelope upon the letter being placed therein. In this manner, additional typing or printing of the name and address of the addressor and of the addressee on the envelope itself is eliminated.

In addition, combination letters and envelopes have been devised wherein letters and envelopes including appropriately configured openings therein have been utilized to facilitate forwarding of letters which include not only addressor and addressee information thereon but a post office cancellation stamp as well.

In addition, numerous other mailing devices have been available wherein envelopes and specialized contents have been provided for facilitating transmittal of communications and packages of various sorts.

Despite the availability of numerous variations of envelopes and contents, none have been available wherein a mailing envelope and contents have permitted rapid and economical production of a numbered communication for transmittal including an attention-getting border which is associated with the number during transmittal thereof and which remains associated therewith upon the communication being removed from the transmittal means.

It is an object of the present invention to provide an improved combination mailing apparatus wherein economical production of a numbered communication for mail transmittal is provided wherein the numbered communication is emphasized during transmittal thereof and remains emphasized after receipt as well.

It is a more particular object of the present invention to provide a combination mailing apparatus wherein addressee information and a control number are affixed to a letter which is appropriately folded and inserted in an envelope which is configured to render the addressee information and number visible through appropriate openings in the envelope. The envelope and letter combination are constructed and arranged so that an attention-getting border appears contiguous the number upon the letter being enclosed within the envelope with the attention-getting border being visible on the letter upon its being removed from the envelope upon receipt.

In accordance with an illustrative embodiment demonstrating objects and features of the present invention, there is provided a business form for use in sending a communication bearing a number having a visible border contiguous said number. The form includes an envelope having an exterior and an interior. The envelope also includes first and second windows within the envelope. A letter is provided having first and second areas on the letter. The first area of the letter is constructed and arranged to receive addressee information. The second area of the letter is constructed and arranged to receive at least one number thereon. A border appears on the letter proximate the second area of the letter. The business form includes means which are constructed and arranged to permit enclosure of the letter within the interior of the envelope with the first and second area being visible from the exterior of the envelope, through the first and second windows respectively. The business form also includes means being constructed and arranged to render the border visible from the exterior of the envelope proximate the second area upon the letter being enclosed within the interior of the envelope with the first and second areas visible from the exterior of the envelope through, respectively, the first and second windows.

The above brief description as well as further objects, features and advantages of the present invention will be more fully understood by reference to the following detailed description of the presently preferred but nonetheless illustrative embodiment in accordance with the present invention, when taken in conjunction with the accompanying drawing, wherein:

FIG. 1 is a fragmentary front plan view of representative envelope of the present invention including a card removably fixed to part of the envelope;

FIG. 2 is a front plan view of a representative letter of the present invention shown folded for insertion within the envelope of FIG. 1;

FIG. 3 is a fragmentary front plan view of a combination mailing apparatus according to the present invention shown with the letter of FIG. 2 inserted within and enclosed by the envelope of FIG. 1;

FIG. 4 is a rear plan view of the envelope and letter of FIG. 3 showing the card removably fixed thereto;

FIG. 5 is an enlarged fragmentary sectional elevational view of the envelope of FIG. 1 taken substantially along the line 5—5 of FIG. 1 and looking in the direction of the arrows;

FIG. 6 is a front plan view of an alternate form of an envelope of the present invention;

FIG. 7 is a front plan view of an alternate form of a letter of the present invention, similar to FIG. 2; and, FIG. 8 is a front plan view, similar to FIG. 3, of the letter of FIG. 7 shown inserted in and enclosed by the envelope of FIG. 6.

Referring now specifically to the drawing and first to FIG. 1, there is shown an illustrative envelope first to FIG. 1, there is shown an illustrative envelope embodying features of the present invention, generally designated by the reference numeral 10, which shows an unassembled envelope body 12 which is generally in the shape of a truncated triangle. The envelope body 12 includes a generally rectangular front face 14, left and right generally triangular areas 16, 18, a lower, generally truncated triangular segment 20 and an upper longitudinally extending flap 22.

As may be seen by reference to FIG. 1, a card 24 is removably fixed to the lower segment 20 for a purpose to be described in detail hereinafter. The segments 16, 18 20 of the envelope body 12 are assembled in the usual manner by the usual methods to form a completed envelope. The flap 22 may include muscilage applied to the upper and outermost edge thereof in the conventional manner for use in fastening the flap to the remainder of the assembled envelope 10. The card 24, which may be used for a return receipt, may be affixed to the envelope 10 before or after assembly thereof when the envelope areas 16, 18, 20 are moved in the direction of the directional arrows $A_1$, $A_2$, $A_3$ (see FIG. 1).

Located within the left-hand portion of the front face 14 of the envelope body 12 is a first window opening 26 which is shown as being generally rectangular but which, of course, can be of any desired configuration in order to fulfill the functions thereof to be described in greater detail hereinafter. A window 28 is formed of a transparent material, which may be glassine, cellophane, or any similar material, is securely fastened to the rear of the front face 14 on the interior of the envelope 10 by any convenient means such as by being glued about the area within the interior of the envelope front face bordering the opening 26.

A generally rectangular window opening 30 appears within the right portion of the front face 14 of the envelope 10 (see, for example, FIGS. 1 and 3). A transparent window 32, formed from a generally rectangular piece of glassine or cellophane or the like, of substantially the same configuration though larger than the window opening 30, is fixed to the interior of the front face 14 of the envelope 10 such as by being glued about the interior edge about the opening 30.

The envelope 10 is assembled in the ordinary manner and, if the card 24 is utilized to obtain a receipt to be returned to the addressor in a manner to be described hereinafter, the card 24 may be affixed subsequent to assembly of the envelope. Naturally, if it is desired, a procedure for affixing the card 24 to the envelope 10 prior to the assembly thereof may be devised.

The exterior of the front face 14 of the envelope 10 includes a contrasting border 34 contiguous the exterior of the second window opening 30 which, in the embodiment shown in FIG. 1, includes the words REGISTERED MAIL within the confines of the border 34 (see, for example, FIGS. 1 and 3).

The border 34 and the words appearing within the confines thereof may be applied to the exterior of the envelope in any convenient manner such as by being preprinted thereon. In the normal situation, the border 34 for the embodiment shown in FIGS. 1 and 3 would be in the color black with the words REGISTERED MAIL visible thereon in white.

If the border 34 is applied by being printed on the envelope 10, at the same time, the name and address of the addressor may be printed on the exterior of the front face 14 of the envelope 10 in the customary position in the upper left-hand corner thereof.

Alternately, a third window may be provided in the front face 14 of the envelope 10 and a return address for the addressor may be shown on the appropriate place on an insert to be enclosed within the envelope 10.

A letter 36 is provided (see FIG. 2) of a width which is less than the longitudinal extent of the front face 14 of the envelope 10 in order to facilitate the enclosure of the letter within the completely formed envelope in a manner to be described. The length of the letter 36 (which, naturally, may be in the form of an ordinary letter or a computer printout or the like) may be of any convenient size and, in a preferred embodiment, is approximately normal letter size.

It is appropriate to note that the business form which is comprised of the letter 36 to be described in detail and the envelope 10 may be of any size and still be within the contemplation of the present invention as long as the letter 36 and the envelope 10 are constructed and arranged as described herein. However, for ease of description, the envelope 10 in its assembled condition is shown as the "standard" business envelope with a front face which is approximately 9 ½ inches in longitudinal extent and approximately 4 inches in width. In a like manner, the letter 36 is shown as the "standard" business letter and is approximately 8 ½ inches in width and approximately 11 inches in length.

As may be noted by reference to FIG. 2, the letter 36 may be folded back upon itself twice in accordion-like fashion to form three equal areas, each approximately 8 ½ inches wide and approximately 3 ⅔ inches high, thereby forming a folded letter which can be easily enclosed within the assembled envelope 10 (see FIG. 3).

The uppermost one-third segment of the letter 36 includes an area location indicating means 38 thereon located on the front face of the letter 6 proximate a first area of the letter generally indicated by the reference numeral 40.

The first area 40 of the letter 36 is located on the front face of the upper third of the letter 36 and is constructed to receive writing or other characters placed thereon in a manner to render them visible within the first window opening 26 formed within the front face 14 of the envelope 10 through the transparent window 28 from the exterior of the envelope 10 upon the letter 36 being folded in the manner shown in FIG. 2 and inserted to be enclosed within the envelope 10.

A second area 42 appears to the right of the first area 40 on the upper third of the face of the letter 36. The second area 42 is positioned on the face of the upper third of the letter 36 to be visible through the window opening 30 formed in the front face 14 of the envelope 10 upon the letter 36 being folded as indicated in FIG. 2 and being inserted to be enclosed within the envelope 10 in a manner that any numbers which are applied to the second area of the letter 36 are visible from the exterior of the envelope 10 within the window opening 30 through the transparent window covering 32.

A border 44 appears on the front of the upper third of the letter 36 proximate the second area thereof and locates the second area. In the illustrative example shown in FIG. 2, the border 44 is in black and includes the words REGISTERED MAIL visible within the border. The border 44 is contiguous the second area and does not completely fill the segment of the upper third of the letter 36 to which it is applied but includes an area in the center thereof constructed for receipt of a number on the face of the letter 36 for a purpose to be described.

The border 42 may be applied to the front face of the letter 36 by any convenient manner such as being printed thereon including the words REGISTERED MAIL. Alternately, the border 44 may be applied by being printed or a separate label which is adhered to the second area 42 on the top third of the front of the letter 36 and which includes a centrally located section permitting viewing therethrough of the number to be applied to the second area of the letter. Alternately, the number may be applied directly to the center area of the label.

If the border 44 is to be printed on the second area 44 of the front of the upper third of the letter 36, the name and return address of the addressor can be simultaneously printed in the upper left-hand corner of the letter 36 which may be visible through a third window within the envelope 10 (not shown).

As noted hereinbefore, the card 24 (which may be a return receipt card which is pre-printed with the return address of the addressor) may or may not be affixed to the rear of the exterior of the envelope 10 as desired. If the card 24 is affixed after the envelope is completely assembled (and before the letter 36 is folded in accordion-like fashion to be inserted within the interior and be enclosed within the envelope 10) the card 24 is fastened to the rear of the envelope 10 only along part of the left and right upstanding edges to permit closing of the flap 22 of the envelope after insertion of the letter 36 within the envelope.

Alternately, after the envelope 10 has had the letter 36 placed therein and the flap 22 has been sealed by conventional means, the card 24 may be affixed to the rear of the completely assembled and sealed envelope.

As may be noted by reference to FIGS. 1, 2 and 3, the size of the window opening 30 within the front face 14 of the envelope 10 permits viewing of the number on the letter 36 (which appears within the second area of the letter) from the exterior of the envelope. Naturally, this presupposes that the letter 36 has been folded in thirds in accordion-like fashion and inserted with the number on the second area aligned with and therefore visible from the exterior of the envelope 10 through the second window. In this configuration the name and address of the addressee (which has been appropriately affixed to the first area of the letter) is visible through the first window opening 26.

The border 34 which has been applied to the exterior of the front face 14 of the envelope 10 proximate the window opening 30 (including the terms REGISTERED MAIL thereon) is visible bordering the number on the second area of the letter when the letter 36 has been inserted within the envelope 10 as described hereinbefore.

FIG. 6 illustrates an alternate method for accomplishing the goals of the present invention. An envelope 46 has been provided which includes a body 48 which is shaped substantially as in the body 12 of the envelope 10 shown in FIGS. 1, 3, 4 and 5.

The body 48 includes a front face 50 which has a first window opening 52 therein which is substantially similar to the window opening 26 within the front face 14 of the envelope 10 (see FIG. 1). The window opening 52 is similarly closed by a window 54 fashioned of glassine, cellophane or the like fixed to the interior of the envelope 46 in a manner similar to the affixation of the window 28 about the window opening 26 described hereinbefore.

A second window opening 56 appears in the front face 50 of the envelope 46 and is located within the front face of the envelope substantially in the same location as was the window opening 30 within the envelope 10. The window opening 56 is closed by a transparent window 58 of glassine or cellophane or the like which is fixed to the interior of the envelope 46 in a manner similar to the manner of affixation of the window 32 to the interior of the envelope 10 (see FIGS. 1 and 5).

The window opening 56 within the front face 50 of the envelope 46 is (as may be seen by comparing FIGS. 1 and 2 with FIG. 6) larger than the window opening 30 within the front face 14 of the envelope 10. Further, the window opening 56 does not include a border thereabout on the envelope 46 as does the window opening 30 within the envelope 10. The reason for the increased size of the window opening 56 compared to the window opening 30 and the lack of a border thereabout will be described hereinafter.

A letter 60 is shown in FIG. 7 which is substantially similar in size and configuration to the letter 36 shown in FIG. 2 including the provision thereon of an area location indicating means 62, which is similar to the area location indicating means 38 on the front of the upper third of the letter 36 shown in FIG. 2.

The letter 60 includes a first area 64 shown on the left in the upper third of the letter folded in accordian-like fashion (see FIG. 7) for receipt of addressee information thereon (such as name, address, etc.). The letter 60 also includes, to the right of the first area 64, a second area 66 within the upper third of the letter for receipt of a number thereon.

A border 68 appears on the letter 60 on the right side of the upper third section shown in FIG. 7 contiguous the second area 66, surrounding the second area 66 and including the words CERTIFIED MAIL thereon. The border 68 may, either be printed on the letter 60 or may be printed on a separate label which is affixed to the right portion of the top third of the letter 60.

The border 68 is constructed and arranged to permit viewing therethrough of the number within the second area 66 of the letter 60, or may bear the number thereon if it is a label.

As with the letter 36 and envelope 10 shown in FIGS. 1 through 5, the letter 60 is shown as being generally 8½ inches wide and 11 inches long. The letter 60 is folded in thirds in an accordion-like fashion to permit insertion therein within the interior of the envelope 46 which is shown as being approximately 9½ inches long and 4 inches wide.

The letter 60 and the first and second areas 64, 66 thereon are constructed and arranged to be visible through the first and second window openings 52, 56 within the envelope 46 upon the tri-folded letter 60 being inserted in the envelope.

In view of the second window opening 56 being larger than the second area 66, the border 68 and the number within the second area 66 of the letter are both visible through the window 58 within the window opening 56 in the envelope 46 when the letter 60 is inserted therein. In this manner, printing of the border on the envelope 46 is eliminated and the border 68 is still visible from the exterior of the envelope 46 (see FIG. 8).

In use, a large-scale user of either registered or certified mail can apply to a local post office to reserve a series of numbers for registration or certification of mail. These numbers are then supplied to a printer (or are programmed to be printed on a series of letters by a computer) and are affixed to the respective second areas 42 or 66 of a letter 36 or 60.

Naturally, a series of such numbers could be affixed, seriatum, to a series of letters 36, 60 by a printing machine, addressing machine or like device. Conceivably, a computer printing machine or addressing machine could also be programmed to place an address on the first areas 40, 64 of the letters 36, 60 while the numbers are being added to the second areas 42, 66 of the same letters.

As a further variation, the addresses 40, 64 could be added manually by the use of a typewriter or by mailing list labels with the numbers being added to the second areas 42, 66 by the use of a numbering machine or like device.

In any event, by use of the present invention it is not necessary to separately number an envelope as both of the envelopes 10, 46 include second window openings 30, 56 through which the numbers on the second areas 42, 66 of the respective letters are visible once the letters are properly inserted within and enclosed by the envelopes.

If the user of the subject business form (which comprises the combination of one of the letters 36, 60 with one of the envelopes 10, 46 either alone or in conjunction with use of the return card 24) desires to send registered mail, a letter 36 is used (after obtaining the required block of registered numbers) which includes a border 44 about the second area which is colored black and includes the words REGISTERED MAIL thereon.

The addressee information is added to the first area 40 of the letter 36 and the registered number is added to the second area 42 of the letter. The letter 36 is then inserted within the envelope 10 with the addressee information on the first area 40 and the registered number on the second area 42 being aligned with and visible through, respectively, the first window opening 26 and the second window opening 30 of the envelope 10.

Naturally, an envelope is selected which includes a black border 34 about and contiguous to the opening 30 and which border includes the words REGISTERED MAIL thereon.

The result of the use of the letter 36 and envelope 10 just described is a letter enclosed within an envelope wherein the addressee information contained on the first area 40 is aligned with and is visible through the window opening 26 in the envelope and the registered number appearing on the second area 42 is aligned with and is visible through the second window opening 30 (see FIG. 3).

The provision on the exterior of the envelope 10 of the black border 34 including the words REGISTERED MAIL thereon draws the attention of the addressee to the importance of the communication. In addition, once the letter 36 is removed from the envelope 10, the appearance of the black border 44 including the words REGISTERED MAIL thereon on the letter itself continuously brings to the attention of the recipient the importance of the communication even after the envelope is discarded.

Naturally, if the user of the business form of the present invention desires to send a certified letter, he need only select a letter 36 which includes a border about the second area which is colored red and which includes the words CERTIFIED MAIL thereon (similar to the letter 60 shown in FIG. 7). In addition, an envelope 10 would be chosen which includes a red border which is contiguous a second window opening 30 and which includes therein the words CERTIFIED MAIL. In such an instance, the user of the subject invention would reserve a block of certification numbers from the local post office for use in numbering the subject letters.

In an alternate form of the present invention, the border 68 about the second area of the letter 60 (which is shown in the preferred embodiment of FIG. 7 as being in red and including the words CERTIFIED MAIL thereon) has the certified number affixed as described hereinbefore to the second area and the addressee information affixed to the first area 64. The letter 60 is then tri-folded in accordion-like fashion and inserted within the envelope 46 in a manner that the addressee information on the first area of the letter 60 is visible from the exterior of the envelope 46 within the first window opening 52 through the window 54 and the certified number within the second area 66 and the red colored border 68 surrounding the certified number are both visible within the window opening 56 through the window 58 (see FIG. 8). As may be noted by reference to FIGS. 6, 7 and 8, if the window opening of the size shown in FIGS. 6 and 8 is utilized, it is not necessary to include the printing of the legend CERTIFIED MAIL within a red border contiguous the second window opening 56 on the envelope 46 though this may be added if desired.

Naturally, if desired, the letter 60 and envelope 46 may be utilized for registered mail if the border 68 is colored black and includes the words REGISTERED MAIL thereon. In addition, the card 24, usable for a return receipt, may be used with the letter 60 and envelope 46 of the embodiment shown in FIGS. 6, 7 and 8.

Once the letter 60 shown in FIGS. 7 and 8 is removed from the envelope 46, it includes the distinctive attention-getting border 68 thereon and the certified number within the second area 66. The letter 60 thereby continuously directs the attention of the recipient thereof to the importance of the communication once the envelope 46 is discarded.

In addition, the assembled business form provides the normal function of indicating the importance of the communication prior to opening by virtue of the visibility of the legend CERTIFIED MAIL, the colored border 68 and the certified number from the exterior of the envelope 46 before the same is opened.

The area location indicating means 38 on the letter 36 (see FIG. 2) and the area location indicating means 62 on the letter 60 (see FIG. 70 are utilized in determining the proper location for the addressee information on the first area 40 on the letter 36 and the first area 64 on the letter 60. The area location indicating means 38, 62 may be utilized by a typist in placing the name of the addressee on the letters 36, 60 if the address information is to be added to the letters by typewriter. If the addressee information is to be added by an addressing machine or other automatic or semiautomatic means, the area location indicating means 38, 62 may be readable by an appropriate sensing device to locate the first areas 40, 64.

As may be noted by reference to FIGS. 3 and 8, when the letters 36, 60 are properly folded in accordion-like fashion and placed within the envelopes 10, 46, the area location indicating means 38, 62 are visible within the window openings 26, 52 through the windows 28, 54 in the upper left-hand corner of the respective windows; and, the addressee information is therefore properly aligned to be visible through the windows as well. Naturally, the number information within the second area 42, 66 is visible within the second window openings 30, 56 through the second windows 32, 58 when the second window openings and the second areas 42, 66 are properly positioned.

Accordingly, the business form which has been described greatly simplifies and reduces the cost of the preparation of registered and certified mail and permits its preparation by automatic or semiautomatic addressing equipment, thereby greatly increasing the number of possible uses thereof.

For example, the present invention permits the use of registered or certified mail for such diverse uses as: product re-call; legal notices of various sorts; notices to personnel of re-commencement of regular employment hours after a work hiatus; credit and collection letter forwarding; forwarding of credit cards; and, such diverse other uses as providing price-change information to retail and wholesale dealers.

As will be readily apparent to those skilled in the art, the invention may be used in other specific forms without departing from its spirit or essential characteristics. For example, the window opening 56 shown in the envelope 46 of FIG. 6 and 8 may be covered with a window (not shown) having a translucent opaque border including the words REGISTERED MAIL or CERTIFIED MAIL in the appropriate color thereon. The present embodiments are, therefore, to be considered as illustrative and not restrictive, the scope of the invention being indicated by the claims rather than by the foregoing description, and all changes which come within the meaning and range of equivalence of the claims are therefore intended to be embraced therein.

What is claimed is:

1. A business form for use in sending a communication bearing a number with a visible attention-getting border contiguous said number, said form comprising an envelope having an exterior and an interior and having first and second windows therein, a letter having a first area and a second area thereon, said first area being constructed and arranged for receiving addressee information thereon, said second area being constructed and arranged for receiving at least one number thereon, an attention getting border on said letter proximate said second area of said letter, said business form including means being constructed and arranged for permitting enclosure of said letter within the interior of said envelope with said first and second areas being visible from the exterior of said envelope through said first and second windows respectively, said business form including means being constructed and arranged for rendering an attention getting border visible from the exterior of said envelope proximate said second area upon said letter being enclosed within the interior of said envelope with said first and second areas being visible from the exterior of said envelope through, respectively, said first and second windows.

2. The invention according to claim 1, said business form including a card removably fixed to said envelope so that said first and second windows remain visible.

3. The invention according to claim 1, said letter including area location indicating means thereon for use in locating said first and second areas respectively.

4. The invention according to claim 1 wherein said means for rendering said attention getting border visible from the exterior of said envelope upon said letter being enclosed within said envelope including said second window being sized to permit viewing of at least a part of said attention getting border on said letter through said second window upon said letter being enclosed within said envelope with said first and second areas being visible through, respectively, said first and second windows.

5. The invention according to claim 4, said attention getting border contiguous said second area on said letter being black.

6. The invention according to claim 4, said attention getting border contiguous said second area on said letter being red.

7. The invention according to claim 1 wherein said means for rendering said attention getting border visible from the exterior of said envelope upon said letter being enclosed within said envelope including an attention getting border on said envelope contiguous said second window.

8. The invention according to claim 7, said attention getting border contiguous said second area on said letter and said attention getting border contiguous said second window, each being black.

9. The invention according to claim 7, said attention getting border contiguous said second area on said letter and said attention getting border contiguous said second window, each being red.

10. The invention according to claim 1, said attention-getting border including means being constructed and arranged for informing a recipient of the business form of the manner of the sending thereof, said business forms means constructed and arranged for rendering said attention-getting border visible from the exterior of said envelope proximate said second area being further constructed and arranged for rendering informing means of said attention-getting border visible from the exterior of said envelope proximate said second area.

* * * * *